US009032901B1

(12) United States Patent
Braun et al.

(10) Patent No.: US 9,032,901 B1
(45) Date of Patent: May 19, 2015

(54) ADAPTOR FOR AN UNMANNED UNDERWATER VEHICLE FOR INSPECTING AN OBJECT AND METHOD FOR PROVIDING SAME

(71) Applicants: Daniel Joseph Braun, San Diego, CA (US); James Benjamin Penney, Carlsbad, CA (US)

(72) Inventors: Daniel Joseph Braun, San Diego, CA (US); James Benjamin Penney, Carlsbad, CA (US)

(73) Assignee: The United States of America, as Represented by the Secretary of the Navy, Washington, DC (US)

( * ) Notice: Subject to any disclaimer, the term of this patent is extended or adjusted under 35 U.S.C. 154(b) by 45 days.

(21) Appl. No.: 14/093,709

(22) Filed: Dec. 2, 2013

(51) Int. Cl.
*B63G 8/08* (2006.01)
*B63G 8/00* (2006.01)

(52) U.S. Cl.
CPC ..... *B63G 8/001* (2013.01); *B63G 2008/002* (2013.01)

(58) Field of Classification Search
USPC ..... 114/337, 338, 222
See application file for complete search history.

(56) References Cited

U.S. PATENT DOCUMENTS 4,157,229 A * 6/1979 Kumm ..... 405/185
5,078,628 A * 1/1992 Garis, Jr. ..... 440/6
7,296,530 B1 11/2007 Bernstein et al.

OTHER PUBLICATIONS

McMaster-Carr products listing (Fastening and Joining, Pipe, Tube, Hose & Fittings, Power Transmission, Sealing, Flow and Level Control Categories), www.mcmaster.com, 4 pages, (printed Dec. 2, 2013).

* cited by examiner

*Primary Examiner* — Stephen Avila
(74) *Attorney, Agent, or Firm* — SSC Pacific Patent Office; Arthur K. Samora; Kyle Eppele

(57) ABSTRACT

An adaptor for an unmanned vehicle for inspecting an object, the adaptor includes a moveable ring assembly and a fixed ring. The moveable ring assembly rotates around a periphery of the unmanned vehicle and allows the unmanned vehicle to move along a surface of the object while maintaining a fixed stand-off distance between an exterior surface of the adaptor and the surface of the object. The fixed ring is connected around the exterior surface of the unmanned vehicle and secures a lateral position of the moveable ring assembly with respect to the unmanned vehicle.

17 Claims, 5 Drawing Sheets

ADAPTOR FOR AN UNMANNED UNDERWATER VEHICLE FOR INSPECTING AN OBJECT AND METHOD FOR PROVIDING SAME

FEDERALLY-SPONSORED RESEARCH AND DEVELOPMENT

The United States Government has ownership rights in this invention. Licensing inquiries may be directed to Office of Research and Technical Applications, Space and Naval Warfare Systems Center, Pacific, Code 72120, San Diego, Calif. 92152; telephone (619) 553-5118; email: ssc_pac_t2@navy.mil. Reference Navy Case No. 101,795.

TECHNICAL FIELD

The present invention pertains generally to an unmanned underwater vehicle. More specifically, the present invention pertains to an unmanned underwater vehicle adapted to inspect a submerged object.

BACKGROUND

Inspection of underwater objects, such as ship hulls, has long been conducted by teams of divers. For large ships, such as container vessels, several man hours are required to complete an inspection. Such an inspection technique is not only cumbersome, time-consuming, and expensive, but also puts the divers conducting the inspection in harm's way.

Marine mammals, such as dolphins, have also been used to conduct inspections of underwater objects. However, the use of such mammals suffers from drawbacks similar to those of divers in terms of time consumption, expense, and exposure to potential dangers.

Unmanned underwater vehicles, autonomous underwater vehicles and remotely operated vehicles have been developed which are capable of mapping and inspecting sections of the seafloor and harbors. Such devices are commonly referred to collectively as UUVs.

UUVs are currently incapable of inspecting objects, such as a ship hull of a floating ship or a submerged object from a close constant stand-off distance. While it is important that a UUV come close to an object to properly inspect it, it is also important that the distance not be too close because of the need to protect the inspection sensors onboard the UUV and the required clearance for the UUV antenna and control surfaces of the UUV. Inspection at too close of a distance may cause such sensitive components to contact the object of interest, causing damage to the components.

There is thus a need for a way to conduct an inspection of an underwater object that overcomes the shortcomings noted above.

SUMMARY

It should be appreciated that this Summary is provided to introduce a selection of concepts in a simplified form, the concepts being further described below in the Detailed Description. This Summary is not intended to identify key features or essential features of this disclosure, nor is it intended to limit the scope of the disclosure.

According to one embodiment, an adaptor is provided for an unmanned vehicle for inspecting an object. The adaptor includes a moveable ring assembly that rotates around a periphery of the unmanned vehicle. The structure of the moveable ring assembly can allow the unmanned vehicle to move along a surface of the object while maintaining a fixed stand-off distance between an exterior surface of the UUV and the surface of the object. The adaptor also includes at least one fixed ring surrounding and mounted to an exterior surface of the unmanned vehicle. The fixed ring secures a lateral position of the moveable ring assembly with respect to the unmanned vehicle.

According to another embodiment, a method is provided for providing an adaptor for an unmanned vehicle for inspecting an object. The method includes mounting a moveable ring assembly around a periphery of the unmanned vehicle, such that the moveable ring assembly allows the unmanned vehicle to move along a surface of the object while maintaining a fixed stand-off distance between an exterior surface of the UUV and the surface of the object. The method further includes connecting at least one fixed ring around the exterior surface of the unmanned vehicle. The fixed ring secures a lateral position of the moveable ring assembly with respect to the unmanned vehicle.

BRIEF DESCRIPTION OF THE DRAWINGS

The following description may be best understood from the accompanying drawings, in which similarly-referenced characters refer to similarly-referenced parts, and in which.

DETAILED DESCRIPTION

Figure 1:
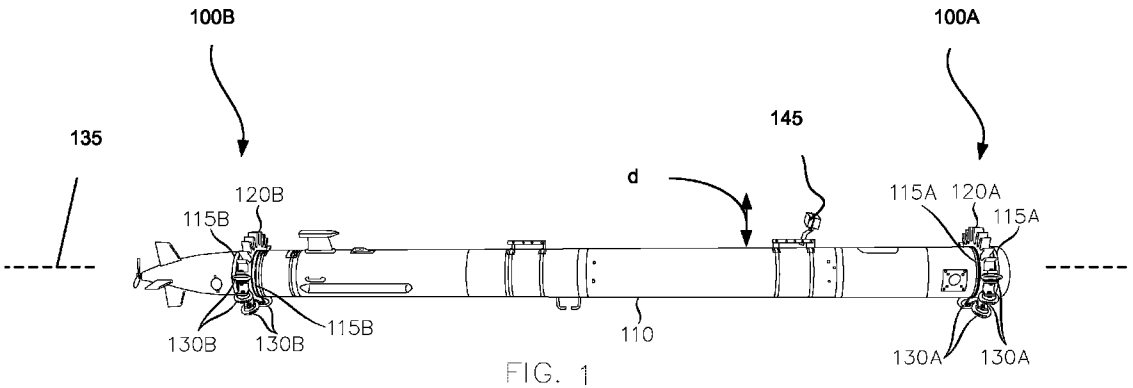
FIG. 1 illustrates an unmanned underwater vehicle with an adaptor according to an illustrative embodiment.

The use of the terms "a" and "an" and "the" and similar references in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein.

All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

According to illustrative embodiments, an adaptor for an unmanned underwater vehicle (in this specification, UUV, unmanned vehicle and underwater unmanned vehicle can be taken to have the same meaning) is provided that allows the UUV to safely inspect an underwater object from a close and fixed stand-off distance. In the description that follows, an "underwater object" refers to objects submerged under water or another liquid, objects floating in water or another liquid, and/or objects filled at least partially with water or another liquid (whether or not such objects are submerged or floating). Examples of objects that may be inspected using a UUV equipped with an adaptor as described herein include, but are not limited to, ship hulls of floating vessels, ship hulls of submerged or sunken vessels, sunken cargo or any another submerged or floating object of interest, as well as liquid-filled interiors of objects such as pipes. It should be appreciated that, although the description that follows refers to UUVs, this term refers to devices that are capable of inspecting objects in liquid, including but not limited to UUVs, AUVs and ROVs, whether such devices are tethered or untethered and whether such devices include artificial intelligence for sensing or not. Additionally, it should be appreciated that the adaptor and/or adaptor/UUV combination of the presented invention can also be used to inspect the inside surface of objects. For example, the device can be submerged within a large pipe or in a large conduit and used to inspect the inner surface of the pipe/conduit.

According to illustrative embodiments, the adaptor for the UUV described herein provides protection to the critical exterior components and hull of the UUV during an inspection mission, as well as the exterior components (if any) of the object being inspected. It also provides the UUV with the improved capability of inspecting, e.g., a ship afloat or a submerged object from a close constant standoff distance. It should be appreciated that that standoff distance "d" may be set as appropriate, to protect the exterior components and hull of the UUV, in a manner described more fully below.

The adaptor can allow the UUV to approach and depart a surface of a submerged, floating, and/or liquid-filled object (such as a pipe or conduit) from any direction. It can also allow the UUV to maintain level trim while inspecting an object with a constant or variable contour. The adaptor can also allow the UUV to roll along the object under inspection while inspection is taking place. The adaptor can also be capable of freely rotating around the UUV to allow the UUV to approach and depart an object of interest at any given variable angle and to perform inspection along any hull or object contour.

FIG. 1 illustrates an unmanned underwater vehicle with an adaptor 100 according to an illustrative embodiment. In FIG. 1, a UUV 110 can include two adaptors 100A, 100B, which can include respective moveable rings 120A and 120B. It should be appreciated, however, that fewer or more adaptors 100 may be provided. The moveable rings 120A and 120B surround the periphery of the UUV 110. The moveable ring 120A can be bracketed by fixed rings 115A that are connected around the exterior surface of the UUV immediately adjacent to moveable rings 120A, as shown in FIG. 1. The fixed rings 115A can maintain the lateral position of the moveable ring 120A with respect to the UUV 110, which can prevent the moveable ring 120A from sliding forward and aft along the surface of the UUV 110. Similarly, the moveable ring 120B can be surrounded by fixed rings 115B that are connected around the exterior surface of the UUV 110. The fixed rings 115B can maintain the lateral position of the moveable ring 120B with respect to the UUV 110, preventing the moveable ring 120B from sliding forward and backward along the surface of the UUV 110. The fixed rings 115A and 115B may be mounted, e.g., to the hull of the UUV 110.

The moveable rings 120A and 120B can be equipped with structure (described more fully in detail below with reference to FIGS. 3 and 4) that can allow the moveable rings 120A and 120B to rotate around the UUV 110. The fixed rings 115A and 115B ensure that the moveable rings 120A and 120B remain in-line with the UUV 110, even as the moveable rings 120A and 120B rotate around the exterior of the UUV 110.

According to the embodiment shown in FIG. 1, the moveable rings 120A and 120B can have attached multiple wheels, of which wheels 130A and 130B can be representative. The wheels 130A and 130B can be evenly spaced at regular intervals around at least a portion of the periphery of the moveable rings 120A and 120B. The wheels 130A and 130B can be affixed to the moveable rings 120A and 120B so that each of the wheels 130 can define a respective wheel plane that can be coincident with a plane that can contain centerline 135 of the UUV 110 (Centerline 135 is shown in FIG. 1). The wheels 130A and 130B can allow the UUV 110 to contact any object at two points per each adaptor, at the respective ends of the UUV 110, and can allow the UUV 110 to roll along an object being inspected with minimal resistance, while at the same time maintaining the original trim and orientation of the UUV (the ballast configuration for maintaining the UUV trim is internal to UUV 110 and is not shown in the Figures).

According to an illustrative embodiment, such as that shown in FIG. 1, a UUV of less than ten feet in length can be outfitted with two adaptors. One adaptor is provided on the UUV at one end of the UUV as far forward as possible, and the other adaptor is provided on the other end of the UUV, as far aft as possible. With two adaptors mounted on the UUV, as shown in FIG. 1, the UUV can contact an object of interest with four wheels at any given time. As the profile of the object or ship hull changes, wheels 130 can roll so that each to move the UUV in a first degree of freedom, while at the same time, each adaptor can adjusts by rotating around the hull of the UUV 110, allowing the UUV 110 to move along a second degree of freedom. When combined with the internal ballast configuration, this can allow the UUV 110 to maintain level trim during the inspection of an object 200 (See FIG. 2) at a fixed standoff distance "d" (distance "d" is shown in FIG. 1).

According to an illustrative embodiment, such as that shown in FIG. 1, the UUV adaptor 100 is adapted for operation on a torpedo-shaped UUV. However, it should be appreciated that the geometry of moveable ring 120 and fixed rings 115 can conform to the geometry of hull of UUV 110, provided the moveable ring 120 and fixed ring structure have flexible structure. For example, UUV 110 can be oval when viewed in cross-section, and moveable ring could have linked chain configuration (such a bicycle chain type of configuration) and fixed ring 115 can be flexible aluminum bands). Other adaptors with different geometries may also be mounted on UUV's with different slopes or profiles so that the moveable ring(s) 120 and fixed ring(s) 115 can conform to the shape of the UUV 110.

In the embodiment shown in FIG. 1, wheels are included only along a portion of the periphery of the moveable rings, such that as the moveable rings rotate radially around the hull of the UUV, two wheels per device always contact the object of inspection. It should be appreciated, however, that wheels may be provided at evenly spaced intervals around the entire periphery of the moveable rings 120.

Figure 2:
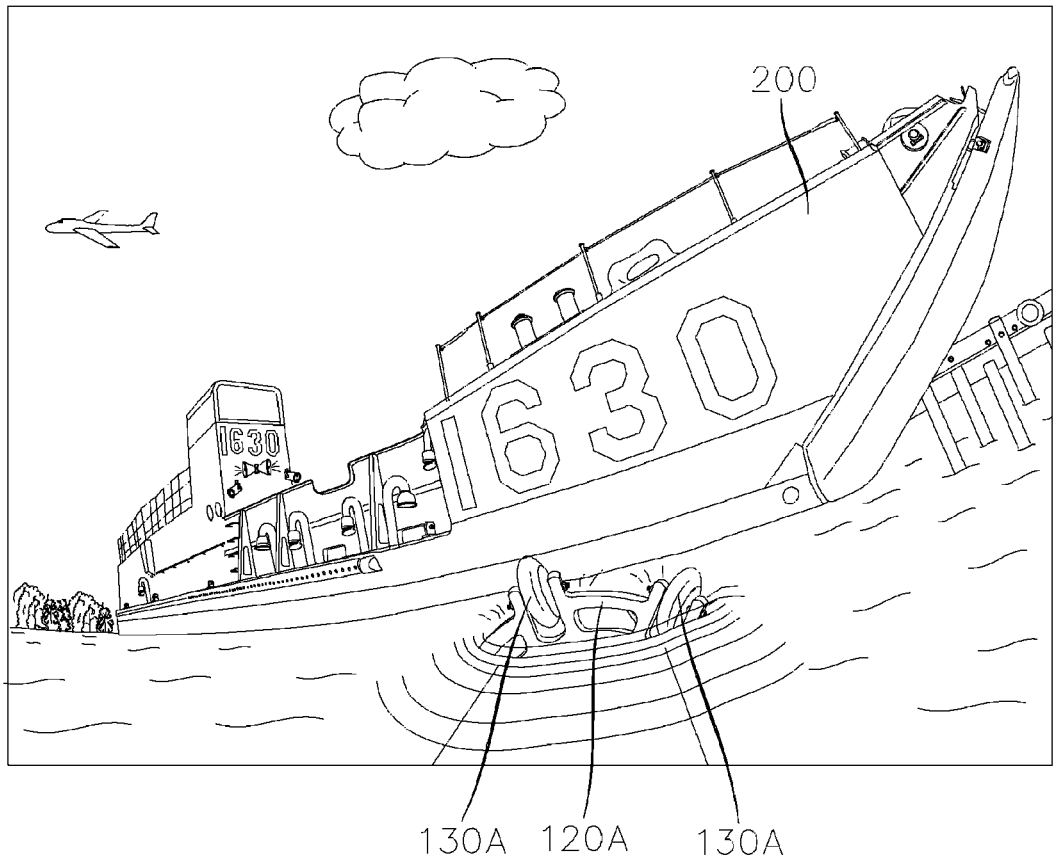
FIG. 2 illustrates an environment in which an unmanned underwater vehicle with an adaptor as described herein may be implemented.
Figure 3:
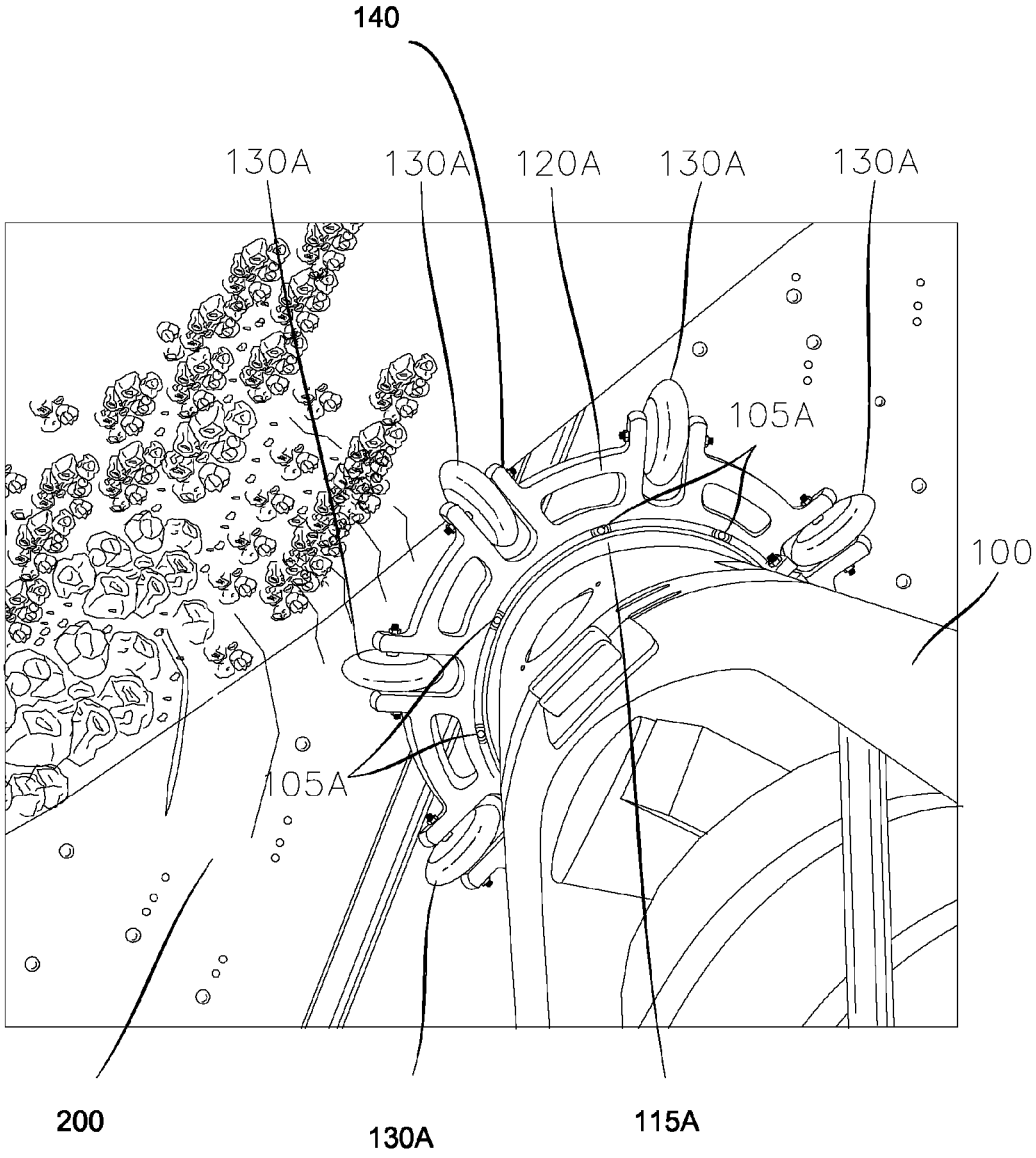
FIGS. 3 and 4 illustrate operation of an unmanned underwater vehicle with an adaptor in inspecting an object according to an illustrative embodiment; and, FIG. 5 illustrates a method for providing an unmanned underwater vehicle with an adaptor according to an illustrative embodiment.
Figure 4:
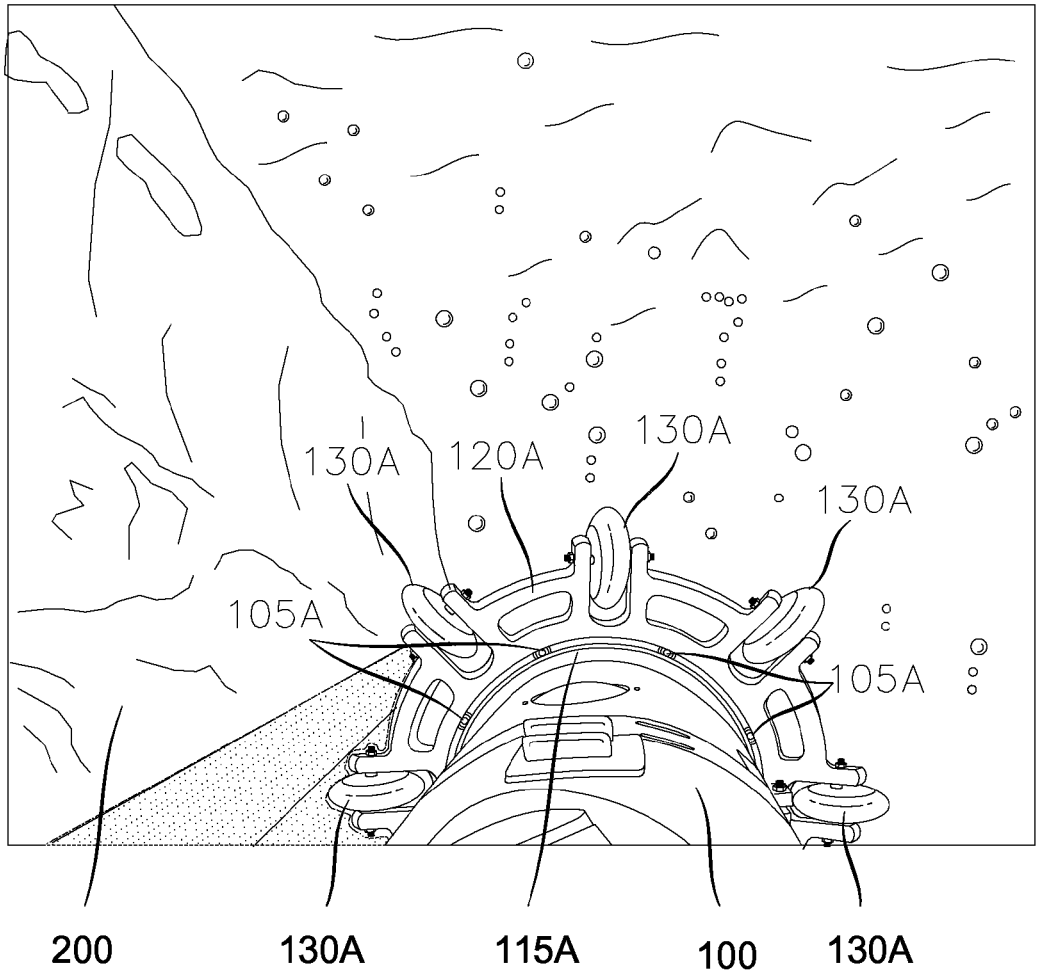

Further details and operation of a UUV outfitted with an adaptor may be understood with reference to FIGS. 2-4. FIG. 2 illustrates an environment in which UUV with an adaptor as described herein may be implemented. In FIG. 2, the UUV 110 is submerged, and the forward adaptor including the moveable ring 120A with wheels 130A is shown as the UUV is approaching a device 200, such as a ship, for hull inspection.

FIGS. 3 and 4 illustrate details and operation of an unmanned underwater vehicle with an adaptor for inspecting an object according to an illustrative embodiment.

As shown in FIGS. 3 and 4, a forward adaptor including a moveable ring 120A attached to a fixed ring 115A and having attached wheels 130A that are positioned between a respective pairs of wheel mounts 140 that extend outwardly from moveable ring 100. This can enable the UUV 110 to roll along the surface of objects to be inspected (e.g., objects 210 and 220) while maintaining a fixed distance "d" between the UUV 110 and the objects being inspected. Also shown in FIGS. 3 and 4 are rollers 105A that can be attached along an inside surface of the moveable ring 120A. As shown in FIGS. 3-4, rollers can be positioned between moveable ring 120A and the UUV 110. The rollers 105A can allow the moveable ring 120A to rotate around the exterior or hull of the UUV 110 in a plane that can be perpendicular to a plane containing centerline 135. The rollers 105A allow the moveable ring 120A to align in any orientation to maintain constant level trim of the UUV 110, parallel to the surface of the water, preventing UUV "roll". Although not illustrated, it should be appreciated that the moveable ring 120B is equipped with rollers similar to 105B that allows the moveable ring 120B to rotate around the exterior of the UUV 110 while mentioning constant level trim of the UUV.

The structure of the adaptor 100 (including the fixed rings, moveable rings, and wheels) may be adjusted so such that that there is a sufficient standoff distance "d" between the UUV 110 and the object 200 being inspected to protect the critical and sensitive components mounted to the hull of the UUV (such as camera 145 in FIG. 1, for example) by preventing the components from contacting the object 200 being inspected. For example, wheel mounts 140 can have a telescoping structure, which can be extended outwardly from UUV 110 and then fixed with a set screw or similar structure prior to deployment of the device, in order to increase the desired standoff distance "d". Typically, the distance "d" can be the distance from the hull of UUV 110 to that outermost point of the adapter 100, usually the outer edge of a wheel 130. Distance "d" can be adjusted so that camera 145 does not contact the object 200 when wheels 130 are in contact with an object 200 during inspection.

Figure 5:
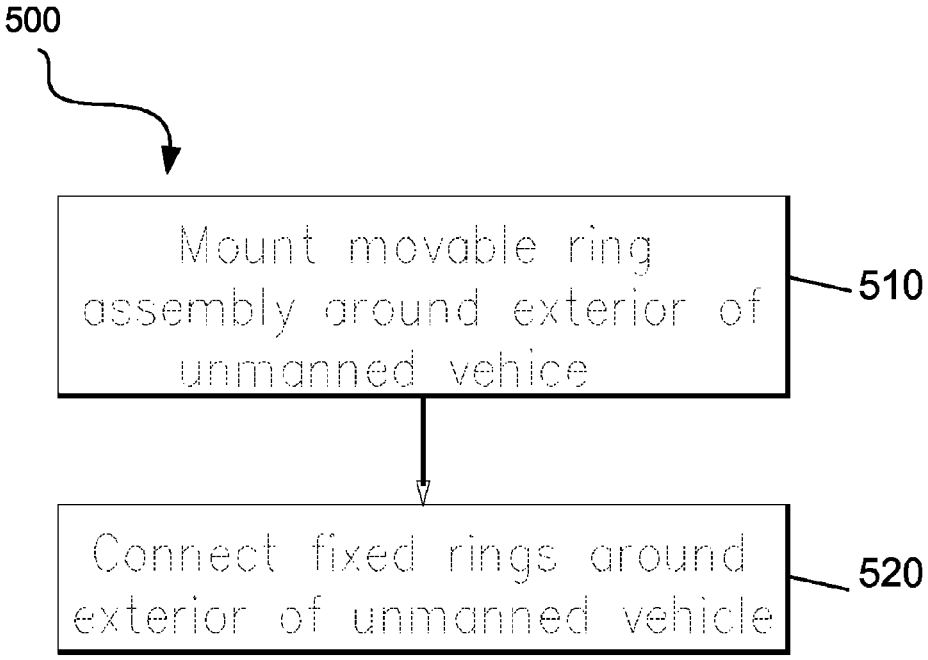

FIG. 5 can illustrate a method 500 for providing an unmanned underwater vehicle with an adaptor according to an illustrative embodiment. Referring to FIG. 5, the method begins at step 510 at which at least one moveable ring assembly is mounted around an exterior of an unmanned underwater vehicle, e.g., the UUV 110. According to an illustrative embodiment, the moveable ring assembly includes moveable rings 120A and 120B and the wheels and rollers attached thereto. At step 520, at least one fixed ring is mounted around an exterior of the UUV 110, to secure the position of the moveable ring assembly so that it does not move forward and backward over the surface of the UUV 110. According to an illustrative embodiment, the fixed ring includes fixed rings 115A attached on either side of moveable ring 120A and fixed rings 115B attached on either side of moveable ring 120B. As a UUV 110 provided with such an adaptor moves around a surface of an underwater object (or along a surface of a liquid-filled object), at least some of the rollers make contact with the object, such that the rollers allow the unmanned vehicle to roll along a surface of the object and thereby inspect the object from a close but fixed stand-off distance.

As noted above, according to illustrative embodiments, the UUV adaptor provides protection to the critical exterior components and hull of a UUV during an inspection mission. Additionally, the adaptor provides the UUV with the improved capability of inspect a ship afloat or a submerged or floating object from a close constant standoff distance. The adaptor allows the UUV to approach and depart a submerged or floating object from any direction. The rollers allow the UUV to maintain level trim, parallel to the surface of the water, and the wheels allow the UUV to inspect a submerged, floating, or liquid-filled object with a constant or variable contour or hull profile.

Although the adaptor described above includes wheels, it should be appreciated that the rollers may be removed, and the adaptor may be rigidly mounted to the hull of the UUV. In this configuration, the UUV may approach an object of interest from a known angle and inspect the object along a known contour. In this embodiment, the width of the adaptor may be selected such that it provides a sufficient standoff distance between the UUV and the object being inspected to protect the critical components of the UUV.

As yet another alternative, instead of mounting the adaptor to the exterior of the hull of the UUV, at least a portion of the adaptor, e.g., the fixed rings, may be integrated directly into the hull section of the UUV. For example, the hull can be formed with ridges and the movable ring 120 can be placed between adjacent ridges to prevent any sliding of the moveable ring forward or aft along the UUV 110. This can provide a lower profile, added rigidity and durability.

It will be understood that many additional changes in the details, materials, steps, and arrangement of parts, which have been described herein and illustrated to explain the nature of the invention, may be made by those skilled in the art within the principle and scope of the invention as expressed within the appended claims.

What is claimed is:

1. An adaptor for an unmanned vehicle for inspecting an object, the adaptor comprising:

a moveable ring assembly that rotates around a periphery of the unmanned vehicle, said moveable ring assembly allowing the unmanned vehicle to move along a surface of the object at a fixed stand-off distance between an exterior surface of the unmanned vehicle and the surface of the object, while the moveable ring assembly is in contact with the object;

wherein the moveable ring assembly comprises a moveable ring that surrounds the exterior surface of the unmanned vehicle, a plurality of wheel mounts that extends outwardly from said moveable ring and a plurality of wheels that are fixed between pairs of adjacent said wheel mounts; and, at least one fixed ring surrounding and mounted to an exterior surface of the unmanned vehicle, wherein the fixed ring secures a lateral position of the moveable ring assembly with respect to the unmanned vehicle.

2. The adaptor of claim 1, wherein at least some of the wheels make contact with the surface of the object, allowing the unmanned vehicle to roll along the surface of the object.

3. The adaptor of claim 2, wherein the wheels define respective wheel planes, and wherein each said wheel plane is coincident with a plane containing a center-line of the unmanned vehicle.

4. The adaptor of claim 2, wherein the moveable ring assembly further comprises rollers slidably positioned along an inner circumference of the moveable ring, wherein the rollers allow the moveable ring to rotate around the exterior surface of the unmanned vehicle.

5. The adaptor of claim 1, wherein the wheel mounts can be extended to adjust the fixed standoff distance.

6. The adaptor of claim 1, wherein the unmanned vehicle has an original trim, and the original trim remains constant while the wheels are in contact with the object as the unmanned vehicle moves along the object.

7. A method for providing an adaptor for an unmanned vehicle for inspecting an object, the method comprising the steps of:

A) mounting a moveable ring assembly around a periphery of the unmanned vehicle, such that the moveable ring assembly allows the unmanned vehicle to move along a surface of the object at a fixed stand-off distance between an exterior surface of the unmanned vehicle and the surface of the object, while the moveable ring assembly in contact with the object;

wherein the step A) is accomplished using a moveable ring assembly that surrounds the exterior surface of the unmanned vehicle, a plurality of wheel mounts that extends outwardly from said moveable ring and a plurality of wheels that are fixed between pairs of adjacent said wheel mounts; and, B) connecting at least one fixed ring around the exterior surface of the unmanned vehicle, wherein the fixed ring secures a lateral position of the moveable ring assembly with respect to the unmanned vehicle.

8. The method of claim 7, wherein the step A) is accomplished so that at least some of the wheels make contact with the surface of the object, allowing the unmanned vehicle to roll along the surface of the object.

9. The method of claim 8, wherein the wheels define respective wheel planes, and wherein each said wheel plane is coincident with a plane containing a centerline of the unmanned vehicle.

10. The method of claim 9, wherein the moveable ring assembly further comprises rollers attached along an inner circumference of the moveable ring, so that the rollers allow the moveable ring to rotate around the exterior surface of the unmanned vehicle.

11. The method of claim 10, wherein the moveable ring rotates in a plane that is perpendicular to a plane containing a centerline of the unmanned vehicle.

12. An unmanned underwater vehicle (UUV) comprising:

a hull;

a moveable ring assembly that rotates around a periphery of the unmanned vehicle, said moveable ring assembly and allowing the unmanned vehicle to move along a surface of the object while maintaining a fixed stand-off distance between an exterior surface of the adaptor unmanned vehicle and the surface of the object, while the moveable ring assembly in in contact with the object;

wherein the moveable ring assembly comprises a moveable ring that surrounds the exterior surface of the hull, a plurality of wheel mounts that extends outwardly from said moveable ring and a plurality of wheels that are fixed between pairs of adjacent said wheel mounts; and, said hull being formed with ridges that maintain the fore-and-aft position of the moveable ring assembly with respect to the unmanned vehicle.

13. The UUV of claim 12, wherein at least some of the wheels make contact with the surface of the object, allowing the unmanned vehicle to roll along the surface of the object.

14. The UUV of claim 13, wherein the wheels define respective wheels planes, and wherein each said wheel plane is coincident with a plan containing a centerline of the unmanned vehicle.

15. The UUV of claim 14, wherein the moveable ring assembly further comprises rollers slidably positioned along an inner circumference of the moveable ring, wherein the rollers allow the moveable ring to rotate around the exterior surface of the unmanned vehicle.

16. The UUV of claim 12, wherein the wheel mounts can be extended to adjust the fixed standoff distance.

17. The UUV of claim 12, wherein the UUV has an original trim, and the original trim remains constant while the wheels are in contact with the object as the UUV moves along the object.

* * * * *